US006773359B1

(12) United States Patent
Lee

(10) Patent No.: US 6,773,359 B1
(45) Date of Patent: Aug. 10, 2004

(54) WOOD TYPE GOLF CLUB HEAD

(75) Inventor: Kung-Wen Lee, Kaohsiung (TW)

(73) Assignee: O-TA Precision Casting Co., Ltd., Pingtung Hsien (TW)

( * ) Notice: Subject to any disclaimer, the term of this patent is extended or adjusted under 35 U.S.C. 154(b) by 0 days.

(21) Appl. No.: 10/421,422

(22) Filed: Apr. 23, 2003

(51) Int. Cl.[7] ..... A63B 53/04
(52) U.S. Cl. ..... 473/327; 473/328
(58) Field of Search ..... 473/327, 328, 473/228; D21/752, 753, 759, 733

(56) References Cited

U.S. PATENT DOCUMENTS 1,619,566 A * 3/1927 Crankshaw ..... 473/242
1,690,388 A * 11/1928 Waldron ..... 473/327
D93,862 S * 11/1934 Bamhart ..... D21/733
D185,717 S * 7/1959 Newton ..... D21/733
3,829,102 A * 8/1974 Harrison ..... 473/228
4,065,133 A * 12/1977 Gordos ..... 473/327
D257,873 S * 1/1981 MacDougall ..... D21/745
5,193,810 A * 3/1993 Antonious ..... 473/327
5,456,469 A * 10/1995 MacDougall ..... 473/328
5,505,448 A * 4/1996 Park ..... 473/327
5,989,134 A * 11/1999 Antonious ..... 473/327
D422,659 S * 4/2000 Mertens ..... D21/752

* cited by examiner

*Primary Examiner*—Sebastiano Passaniti

(57) ABSTRACT

A wood type golf club head has a hollow body, an air fin and air guides. The hollow body has a front, a rear, a crown and a sole. The crown has a top convex surface with a symmetric central line. The air fin is formed perpendicularly from the convex top surface of the crown from the front to the rear of the hollow body along the symmetric central line of the convex top surface. The air guides are defined on the sole with a forked configuration and are extended to the air fin. The air fin and the air guides will reduce external airflow effects during the golf club head moving. Consequently, the motion and direction of the motion of the golf club head will be stable such that a golfer will swing successfully to hit a golf ball.

4 Claims, 4 Drawing Sheets

WOOD TYPE GOLF CLUB HEAD

BACKGROUND OF THE INVENTION

1. Field of the Invention

The present invention relates to a wood type golf club head, and more particularly to a golf club head has an air fin and air guides that will guide an external airflow over the golf club head to aid a golfer to swing steadily.

2. Description of Related Art

A golf club typically has a shaft, a grip and a head. The shaft has two ends. The grip is attached to one end of the shaft, and the head is attached to the other end of the shaft. A golfer holds the grip and swings the golf club to hit a golf ball.

A wood golf club head generally has a crown, a sole, a face with a center of impact, called a "sweet spot", etc. that are all well-known in this art. The sweet spot represents the spot of desired contact with the, ball. In order to increase an area of the sweet spot, the golf club head is fabricated with as large a volume as possible. However, a large volume of the golf club head represents a large wind resistance and an external airflow over the golf club head as the golf club head is traveling.

The external airflow over the golf club head will effect the motion and direction of the head during a period of the golf club head while moving. In aerodynamics, the wind resistance and the external airflow over an object will effect and disturb the motion and the direction of the motion of the object. Likewise, when the golf club head undergoes the wind resistance and the external airflow, the motion and the direction of the motion of the golf club head will be effected and disturbed during the period of swing. Therefore, the wind resistance and the external airflow effects of the golf club head must be diminished.

With reference to FIG. 5, which shows a head (20) for a wood golf club in accordance with prior art, the head (20) does not have any air guide device to reduce the wind resistance and the external airflow negatively effects travel of the head (20). With use of this type of the head (20), the golfer perhaps cannot hit the ball precisely and successfully with the sweet spot. Because the wind resistance and the airflow will disturb the motion of the head (20), the direction of the motion of the head (20) will become unstable. Therefore, it is difficult for the golfer to be able to successfully hit the ball with the sweet spot.

To overcome the shortcomings, the present invention provides a wood golf club head with an air guide device to mitigate or obviate the aforementioned problems.

SUMMARY OF THE INVENTION

The main objective of the invention is to provide a wood type golf club head with an air fin and air guides to efficiently reduce external airflow effects of the golf club head.

The objective is accomplished with use of a golf club head that has a hollow body, an air fin and air guides. The hollow body has a front, a rear, a crown and a sole. The crown has a top convex surface with a symmetric central line. The air fin is formed perpendicularly from the convex top surface of the crown from the front to the rear of the hollow body along the symmetric central line of the convex top surface. The air guides are defined on the sole with a forked configuration and connect to the air fin. The air fin and the air guides will reduce the external airflow effects over the golf club head as it moves when a golfer swings. Consequently, the motion of the golf club head will be stable such that a golfer can swing to successfully hit a golf ball.

Other objectives, advantages and novel features of the invention will become more apparent from the following detailed description when taken in conjunction with the accompanying drawings.

DETAILED DESCRIPTION OF PREFERRED EMBODIMENT

Figure 1:
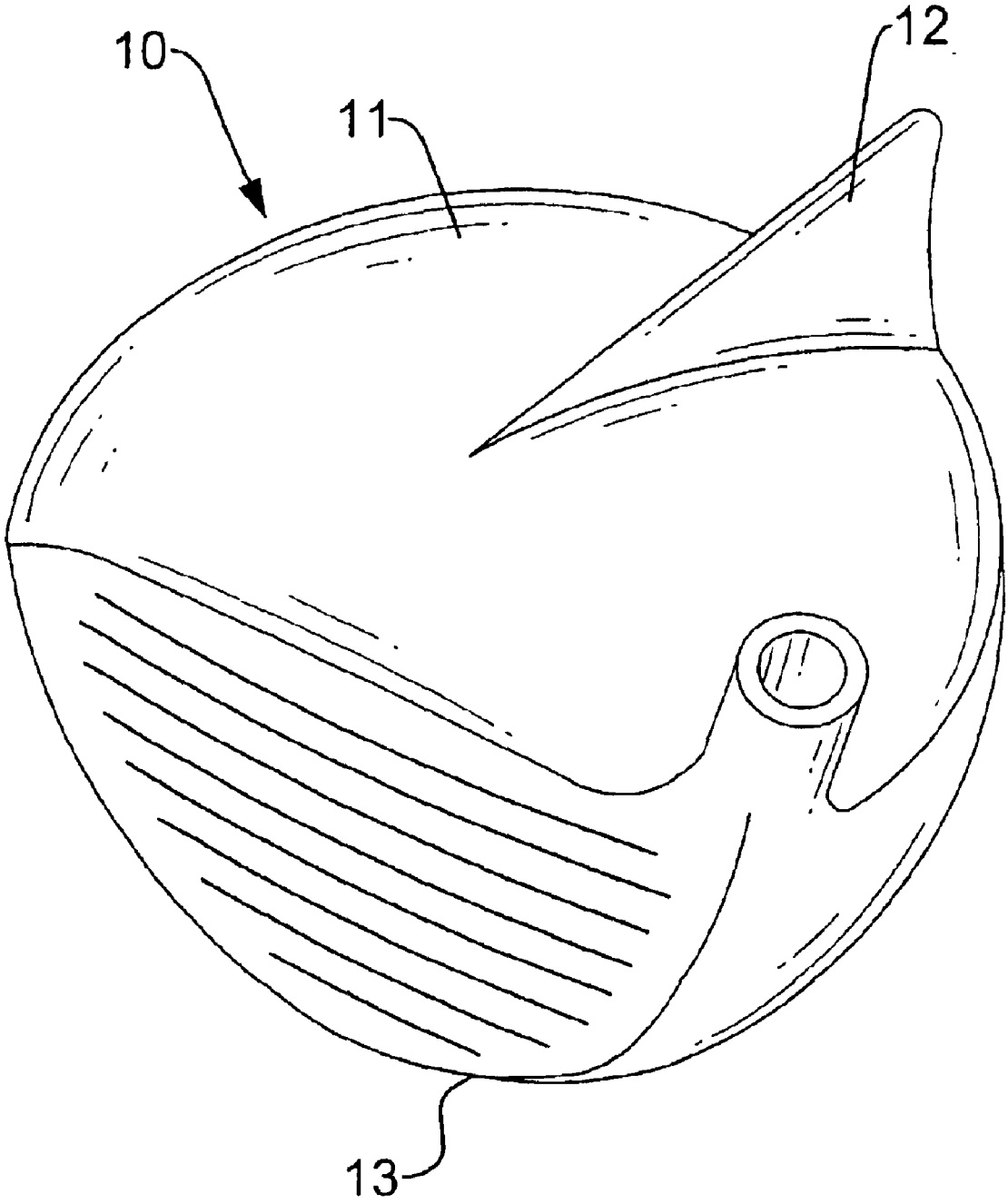
FIG. 1 is a perspective view of a wood type golf club head with an air fin and air guides in accordance with the present invention.
Figure 3:
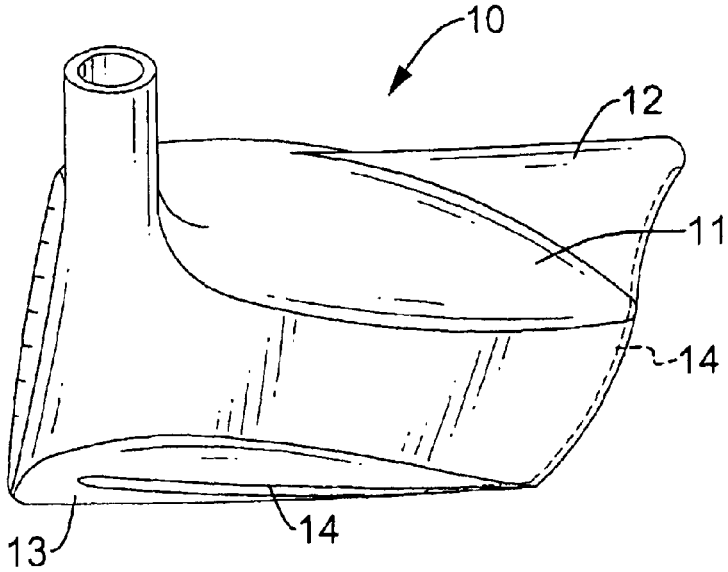
FIG. 3 is a side plan view of the golf club head in FIG. 1.

With reference to FIGS. 1 and 3, a golf club head in accordance with the present invention comprises a hollow body (10) and an air fin (12). The body (10) has a front (not numbered), a rear (not numbered), a top (not numbered), a bottom (not numbered), a crown (11), a sole (13), a hosel (not numbered), a face (not numbered) and air guides (14). The face is formed at the front of the hollow body (10) for hitting a ball. The crown (11) is formed on the top of the hollow body (10). The hosel protrudes from the crown (11) and is adapted to connect the hollow body (10) to a shaft (not shown). The sole (13) is formed at the bottom of the hollow body (10). All of the crown (11), the face, the hosel and the sole (13) are conventional and are well-known in this art.

Figure 2:
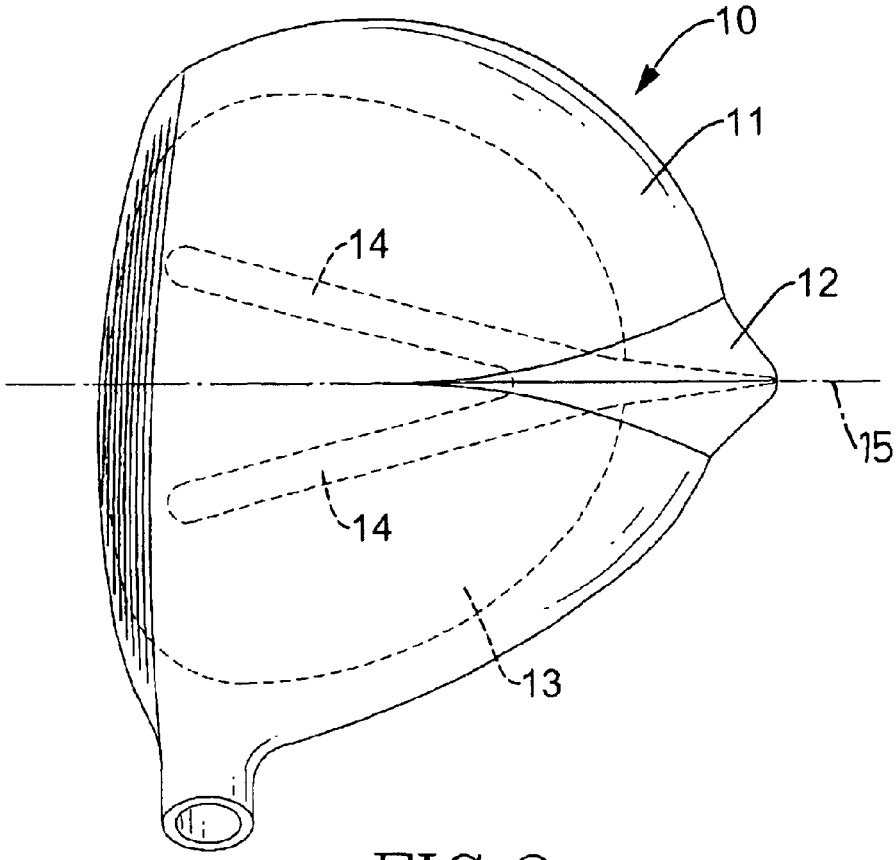
FIG. 2 is a top plan view of the golf club head in FIG. 1.

With further reference to FIG. 2, the crown (11) has a convex top surface (not numbered) with a symmetric central line (15) and a peak (not shown). The air fin (12) is formed perpendicularly from the convex top surface of the crown (11) from the front to the rear of the hollow body (10) along the symmetric central line (15) of the convex top surface. The air fin (12) is formed with respect to the direction of the motion of the hollow body (10) and has a peak (not numbered). Preferably, the peak of the air fin (12) is higher than the peak of the convex top surface of the crown (11) and is 0.001 to 50 mm (millimeters) relative to the peak of the convex top surface. The air fin (12) is just like a tail fin of an airplane and will guide the external airflow that flows over the crown (11) to be smooth. The air fin (12) will keep the direction of the motion of the hollow body (10) to be stable during the period of swing.

Figure 4:
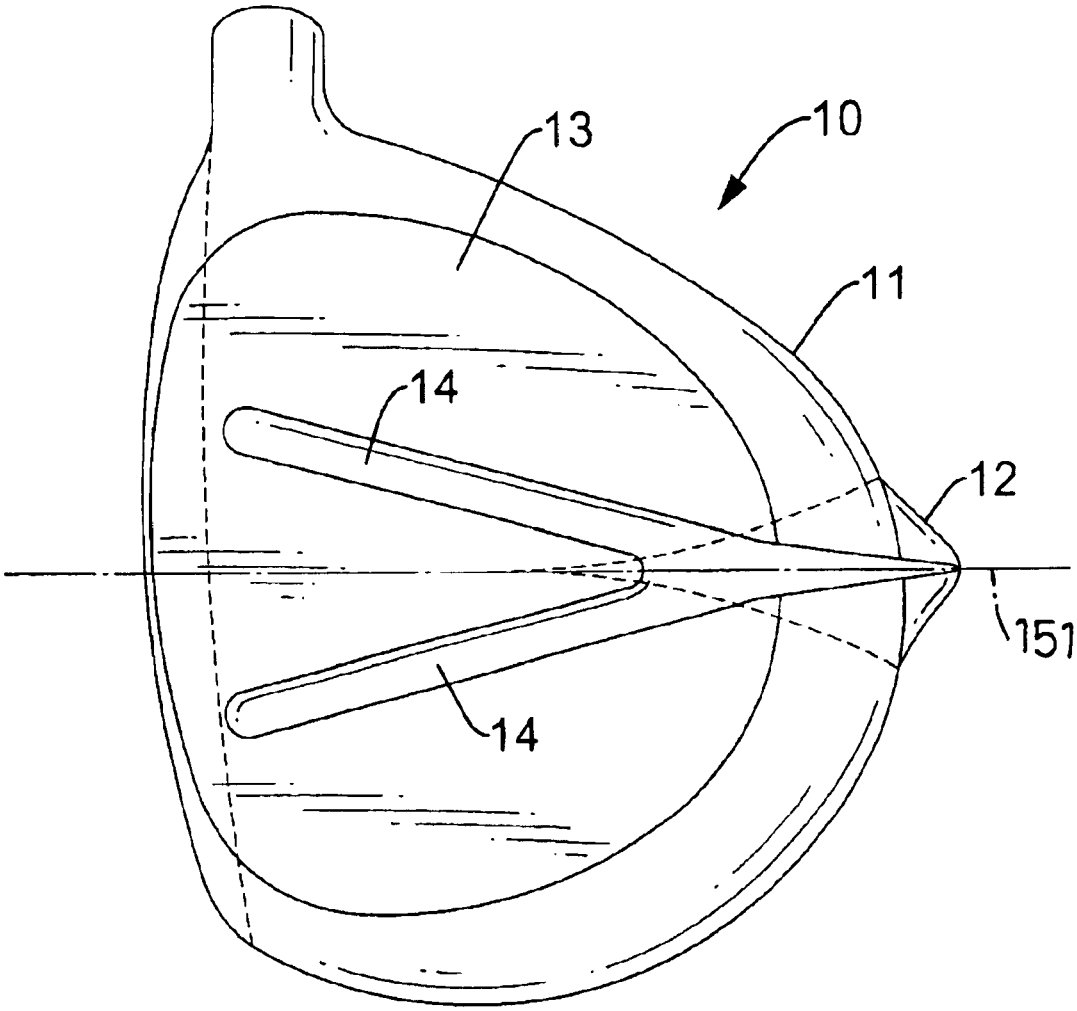
FIG. 4 is a bottom plan view of the golf club head in FIG. 1.
Figure 5:
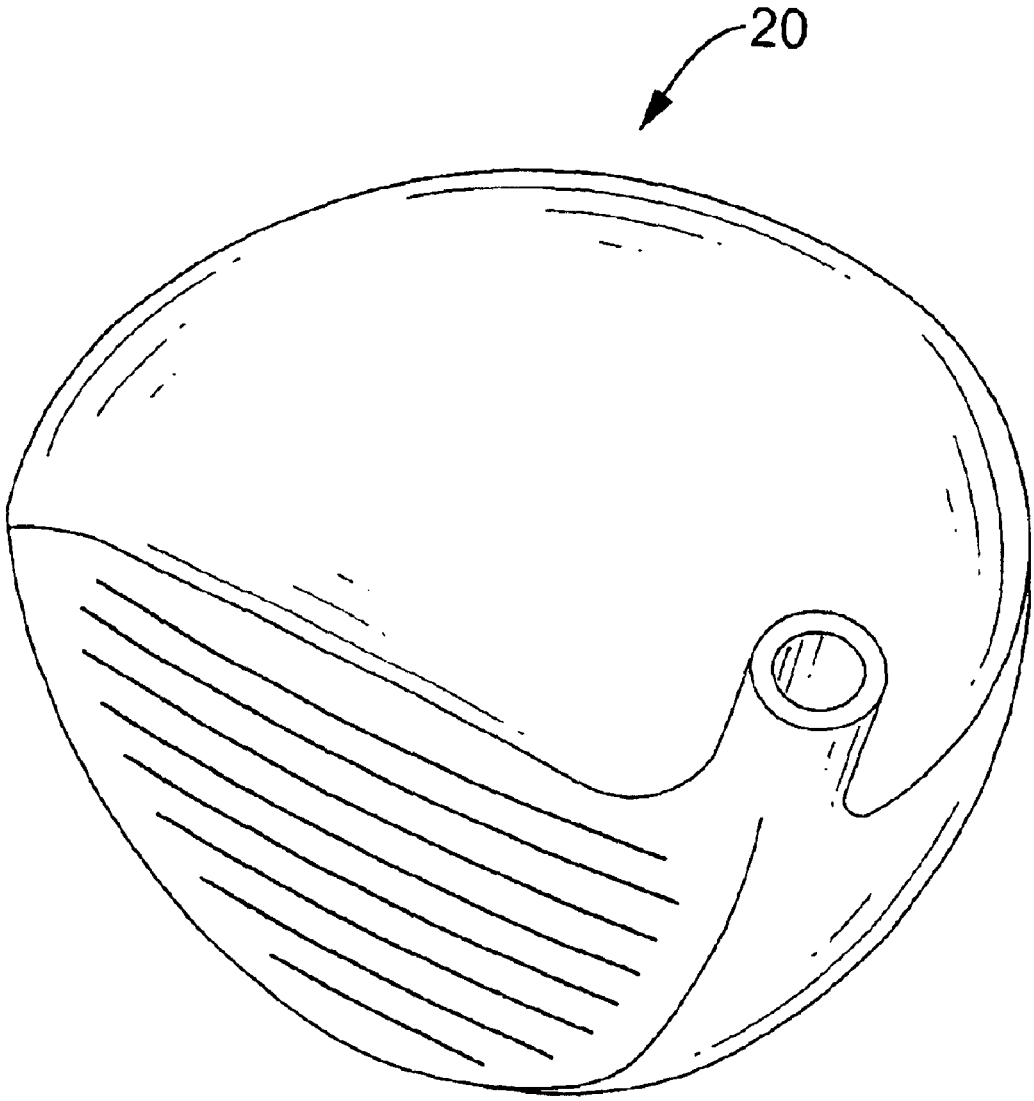
FIG.5 PRIOR ART
FIG. 5 is a perspective view of a wood type golf club head in accordance with the prior art.

With reference to FIGS. 2, 3 and 4, the sole (13) has a bottom surface (not numbered) with a symmetrical central line (151) aligned with the symmetrical central line (15) of the convex top surface of the crown (11). The air guides (14) are symmetrically defined in the sole (13) relative to the symmetric central line (151) of the bottom surface from the front to the rear of the hollow body (10). The air guides (14) are arranged with a forked configuration and are extended to the air fin (12). Each air guide (14) has a width (not shown) and a depth (not shown). The width of the air guide (14) is 0.001 mm (millimeters) to 35 mm, and the depth of the air guide (14) is 0.001 mm to 3.5 mm. Likewise, the air guides (14) will guide the external airflow that flow over the sole (13) to be smooth. The air guides (14) will also keep the direction of the motion of the hollow body (10) to be stable during the period of swing.

Therefore, the air fin (12) and the air guides (14) will efficiently diminish the effects of the external airflow over the hollow body (10) such that the wind resistance of the golf club head will also be reduced during the movement of the hollow body (10). Smooth external airflow over the hollow body (10) means that the wind resistance effects on the hollow body (10) will be reduced. A small wind resistance of the hollow body (10) will keep the direction of the moving hollow body (10) to be stable. By ensuring that the ball is struck well by the sweet spot of the club, the golfer will be able hit the ball more accurately and further.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A wood type golf club head, comprising;

a hollow body with a front, a rear, a top and a bottom having a crown formed at the top of the hollow body and having a convex top surface with a peak and, a symmetric central line defined from the front to the rear of the hollow body;

an air formed perpendicularly from the convex top surface along the symmetric central line of the convex top surface and having a peak;

a sole formed at the bottom of the hollow body and having a bottom surface and a symmetric central line aligned with the symmetrical line of the convex top surface of the crown; and two air guides symmetrically defined in the bottom surface of the sole with respect to the symmetric central line of the sole, each air guide having a width, a depth, and being arranged with a forked configuration and extended to the air fin.

2. The golf club head as claimed in claim 1, wherein the width of each air guide is 0.001 millimeter to 35 millimeters and the depth of each air guide in 0.001 millimeters to 3.5 millimeters.

3. The golf club head as claimed in claim 1, wherein the peak of the air fin is 0.001 to 50 mm relative to the peak of the convex top surface of the crown.

4. The golf club head as claimed in claim 2, wherein the peak of the air fin is 0.001 to 50 mm relative to the peak of the convex top surface of the crown.

* * * * *